US005379901A

United States Patent [19]

Blachut

[11] Patent Number: 5,379,901

[45] Date of Patent: Jan. 10, 1995

[54] CONTAINER MODULE WITH INTERCHANGEABLE TRAYS IN PARTICULAR FOR SUITABLE CASES FOR CONTAINING COSMETIC PRODUCTS

[75] Inventor: Longin Blachut, Lugano, Switzerland

[73] Assignee: Techpack-Laffon GmbH, Munich, Germany

[21] Appl. No.: 119,684

[22] Filed: Sep. 13, 1993

[30] Foreign Application Priority Data

Sep. 11, 1992 [IT] Italy ..... MI92 U 000822

[51] Int. Cl.[6] ..... A45D 33/20

[52] U.S. Cl. ..... 206/581; 206/823; 132/294; 132/315

[58] Field of Search ..... 206/581, 823, 1.5; 132/294, 314, 315; 220/410

[56] References Cited

U.S. PATENT DOCUMENTS

| | | | |
|---|---|---|---|
| 4,421,127 | 12/1983 | Geer | 206/823 X |
| 4,538,725 | 9/1985 | Glover et al. | 132/294 X |
| 4,589,430 | 5/1986 | Sussman | 132/294 X |
| 4,889,254 | 12/1989 | Vola | 206/581 X |
| 5,005,697 | 4/1991 | Jimbo et al. | 206/581 X |
| 5,092,354 | 3/1992 | Pacelli, Jr. | 206/581 X |
| 5,161,556 | 11/1992 | Audebourg et al. | 206/823 X |
| 5,199,451 | 4/1993 | Montoli | 206/823 X |

*Primary Examiner*—Jacob K. Ackun, Jr.
*Attorney, Agent, or Firm*—Cushman Darby & Cushman

[57] ABSTRACT

A container module with interchangeable trays, in particular, but not exclusively, for suitable cases for containing cosmetic products, comprises a container (11) provided with a plurality of polygonal seats (13) suitable for housing corresponding modular trays (14, 15), with, between said seats (13) and said trays (14, 15) retainer means for freely disengageable fastening are provided.

4 Claims, 7 Drawing Sheets

Fig.11
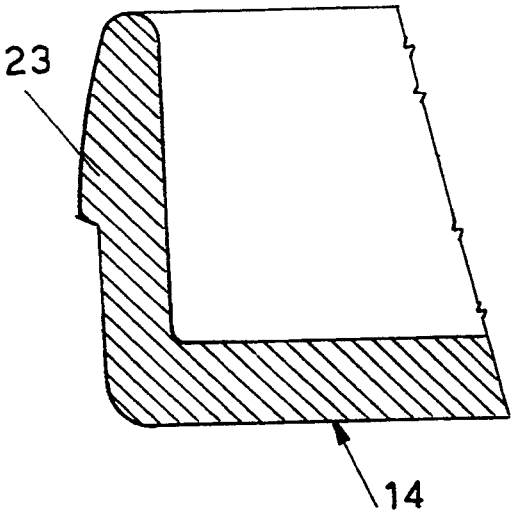
Fig.8
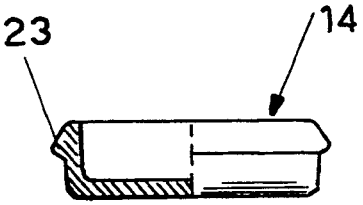
Fig.7
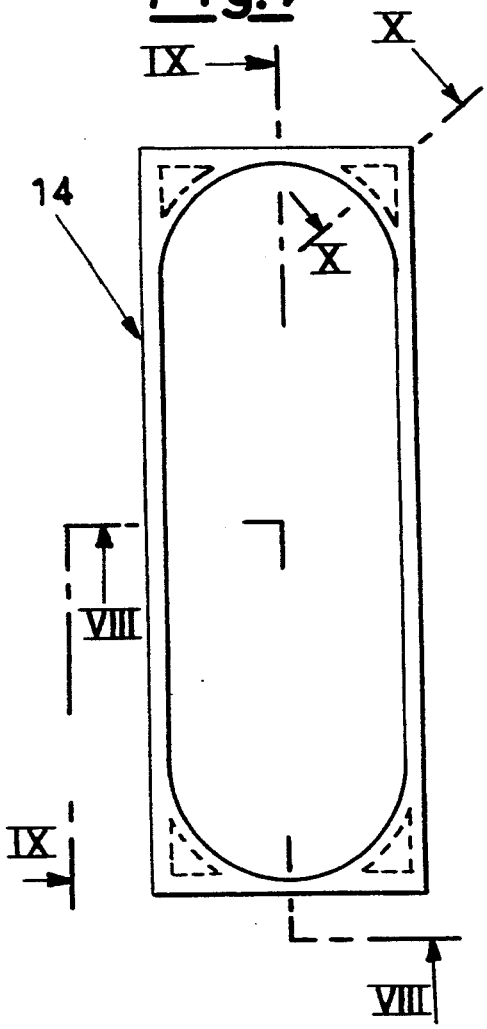
Fig.9
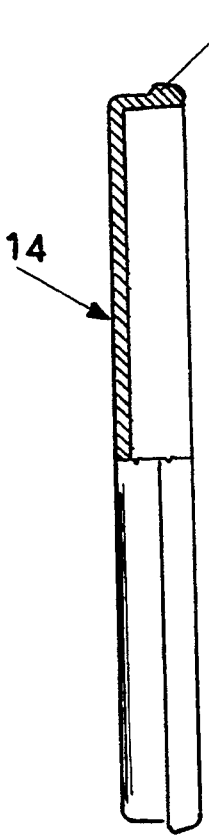
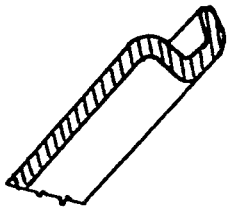
Fig.10

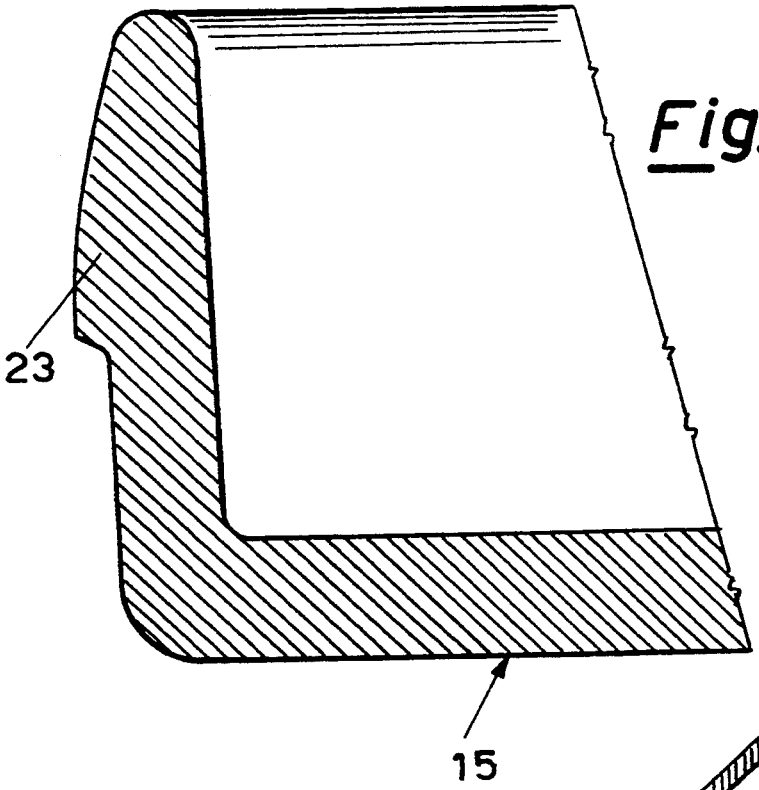
Fig. 21
Fig. 18
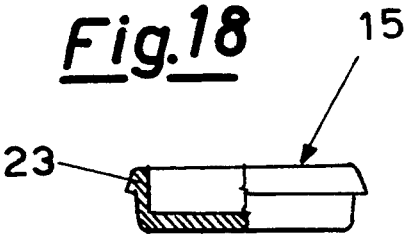
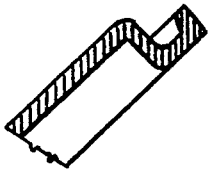
Fig. 20
Fig. 17
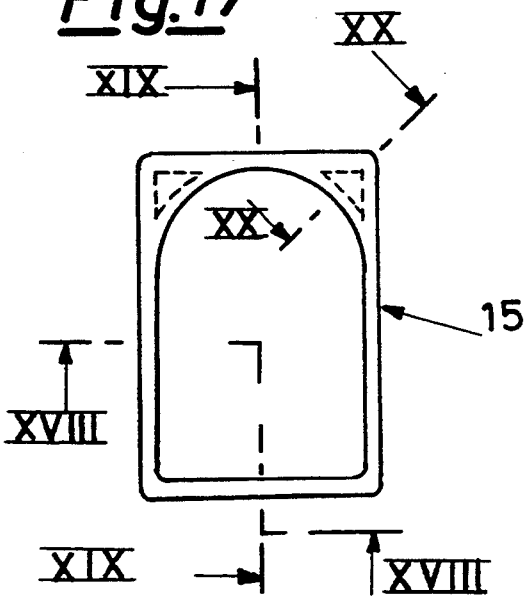
Fig. 19
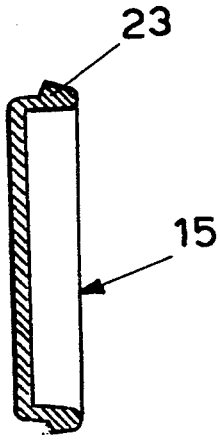

CONTAINER MODULE WITH INTERCHANGEABLE TRAYS IN PARTICULAR FOR SUITABLE CASES FOR CONTAINING COSMETIC PRODUCTS

BACKGROUND OF THE INVENTION

The present invention relates to a container module provided with interchangeable trays—commonly designated, by a French word, "godet" in this field—for suitable cases for containing cosmetic products, such as, shadowing, fard powder, lip polisher cream, lipstick powder, powder.

The interchangeable tray container module according to the present invention could be used in order to contain other product types different from cosmetic products.

As those skilled in the art are well aware, providing suitable cases for containing such cosmetic products as mentioned above, requires that several technical problems are solved.

One problem arises from the possibility of retaining the case, once at least some of the products contained inside it are exhausted, with only the exhausted godet being replaced, replacement are found on the market as specific refills for particular cases.

Another technical problem relates to the possibility of replacing the godet housed inside the case, easily and as desired, with other godet containing different cosmetic products without the user has to soil his/her fingers.

Furthermore, it is desirable that a case be provided with an interior lay-out in which the assembled godet form an aesthetically pleasant, and also variable, pattern.

SUMMARY OF THE INVENTION

The general purpose of the present finding is of solving the above listed problems in a simple and cheap way.

BRIEF DESCRIPTION OF THE DRAWINGS

The structural and functional characteristics of the present invention and its advantages over the prior art will become more evident from an examination of the following description, made by referring to the accompanying drawings, which display an example of a container module with interchangeable godet, made according to the novel principles of the present invention.

In the drawings:

FIG. 7 shows a top plan view showing a large godet;

FIG. 8 shows a sectional view made according to the plane represented by the line VIII—VIII of FIG. 7;

FIG. 9 shows a sectional view made according to the plane represented by the line IX—IX of FIG. 7;

FIG. 10 shows a sectional view made according to the plane represented by the line X—X FIG. 7;

FIG. 11 shows an enlarged view of the edge of the godet of FIG. 7;

FIG. 17 shows a top plan view showing a small godet;

FIG. 18 shows a sectional view made according to the plane represented by the line XVIII—XVIII of FIG. 17;

FIG. 19 shows a sectional view made according to the plane represented by the line XIX—XIX of FIG. 17;

FIG. 20 shows a sectional view made according to the plane represented by the line XX—XX of FIG. 17;

FIG. 21 shows an enlarged view of the edge of the godet of FIG. 17;

DETAILED DESCRIPTION

Figure 1:
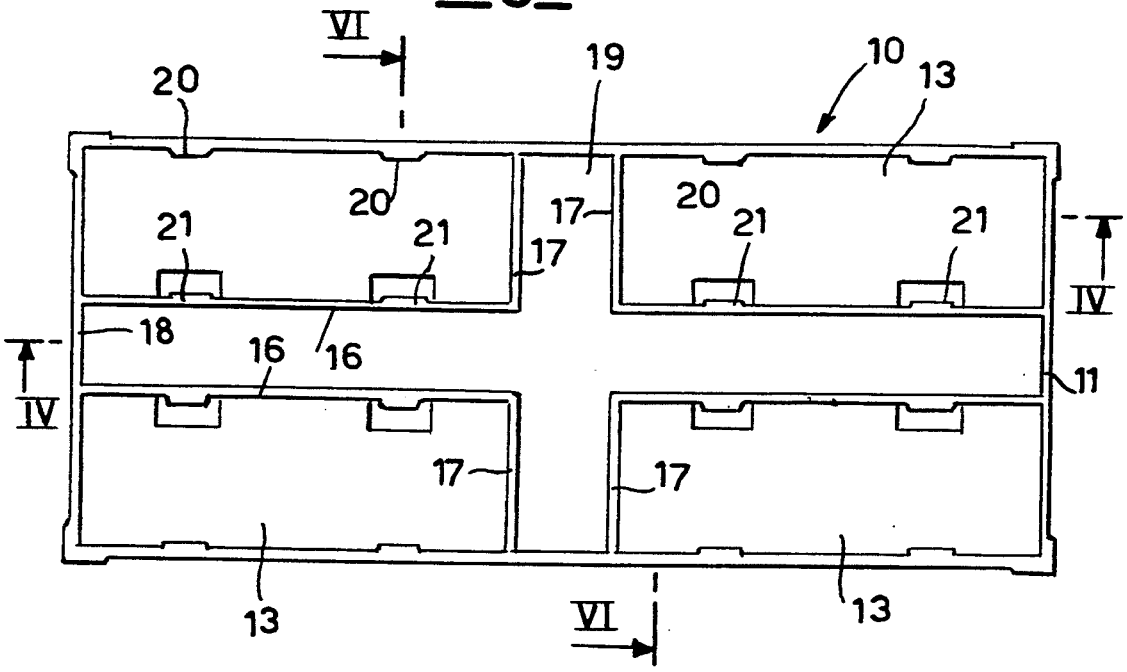
FIG. 1 shows a top plan view of the container module according to the present invention.
Figure 2:
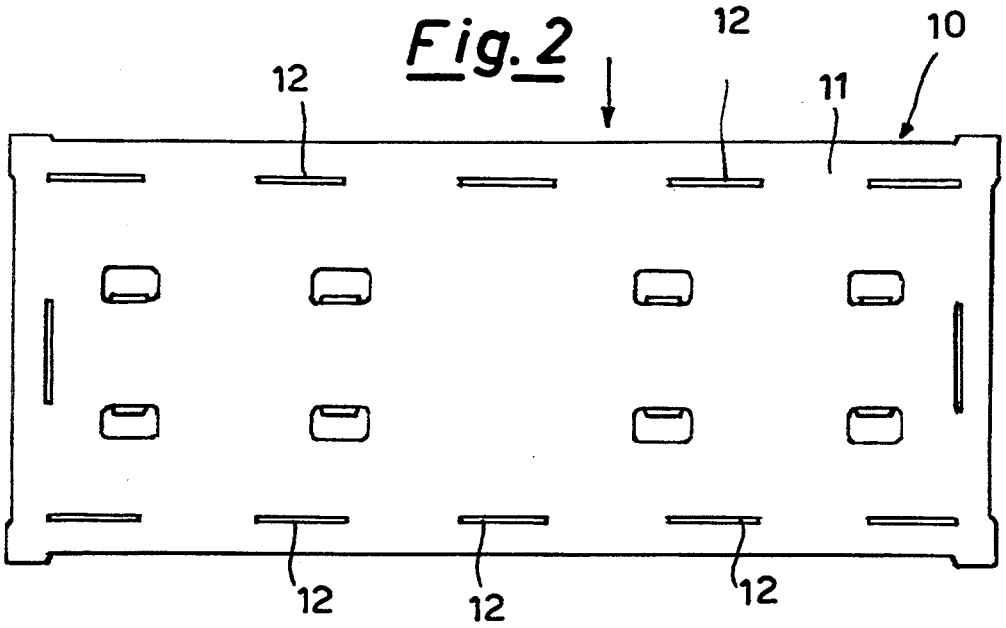
FIG. 2 shows a bottom plan view of the module of FIG. 1.
Figure 3:
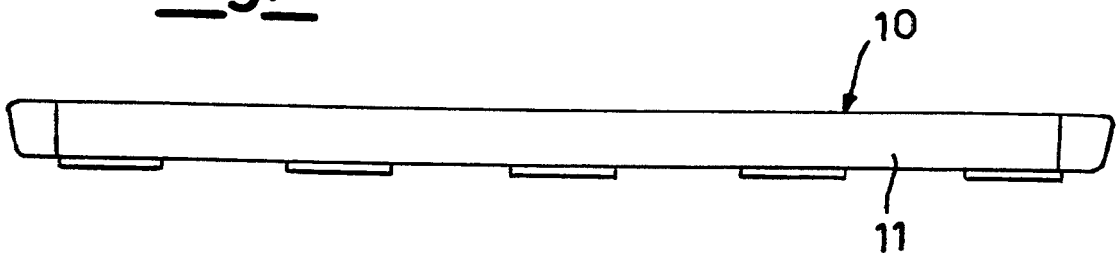
FIG. 3 shows a longitudinal elevation view thereof.
Figure 4:
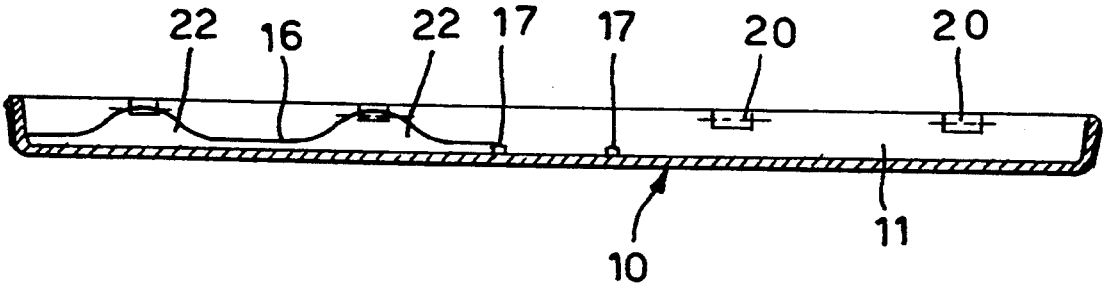
FIG. 4 shows a sectional view made according to the plane represented by the line IV—IV of FIG. 1.
Figure 5:
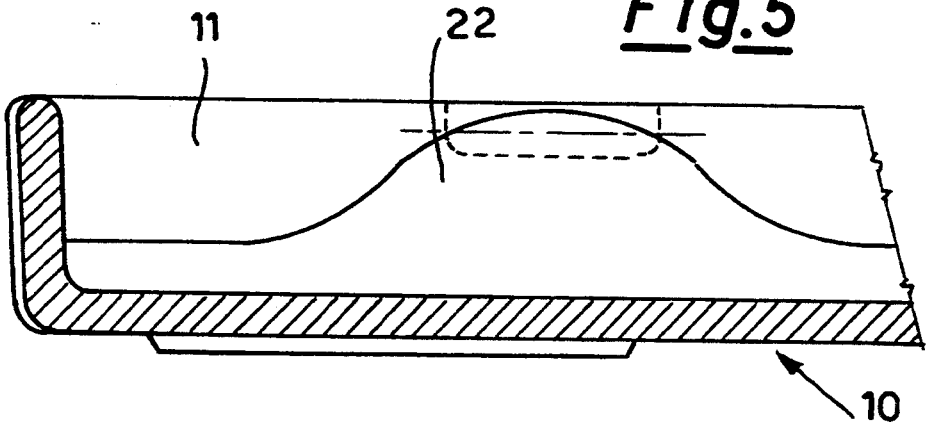
FIG. 5 shows an enlarged view of a detail of the cross-sectional view of FIG. 4.

By referring to FIGS. 1 and 2 of the drawings, the container module according to the present finding is generally indicated with 10 and is structurally formed by a suitable rectangular container 11 suitable for being inserted into, and fastened inside, a corresponding seat of a case (not shown), for example designed to contain cosmetic products.

For fastening purpose, the container 11 is provided, on the outer surface of its bottom (FIG. 2), with an array of lines 12 for ultrasound welding. Of course, the container 11 can be fastened to the case (not shown) by also using other fastening means, different from ultrasound welding, such as, e.g., adhesives and so on.

In a characteristic way, the container 11 is provided, inside its interior, with a plurality of rectangular seats 13 (in the depicted example, four seats are present), suitable for housing corresponding modular godet 14, 15 (FIGS. 7, 17).

The seats 13 are bounded by the side walls of the container 11 and low, longitudinal and transversal ribs 16 and 17, respectively, vertically extending from the same container 11.

As one may clearly see from FIG. 1 of the accompanying drawings, ribs 16, 17 are suitably spaced apart from each other, such as to define free spaces 18, 19, which can be used for housing small brushes, as well as in order to provide the necessary room for user's fingers for comfortably pulling out the godet 14, 15 from their respective housings.

The godet 14, 15 are housed inside their seats 13 in a stable way, but with possibility of free removal. For such a purpose, each seat 13 is provided with two pairs of mutually opposite teeth 20, 21 respectively provided on the longitudinal walls of the container 11 and on elastically yielding tongues 22 (FIG. 6) vertically extending from the ribs 16, with which they are integral.

Figure 6:
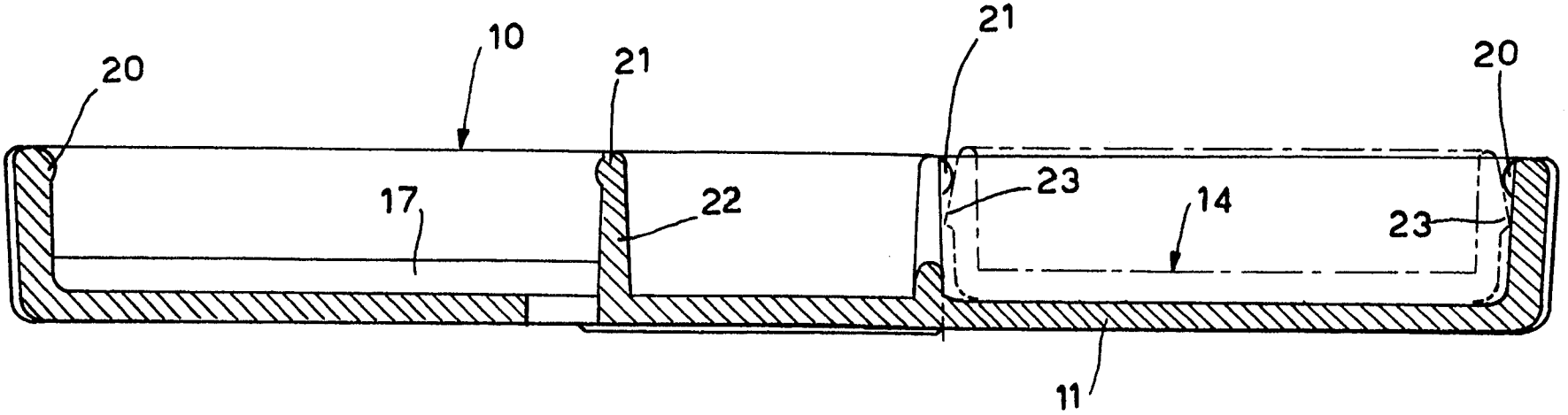
FIG. 6 shows a sectional view made according to the plane represented by the line VI—VI of FIG. 1.
Figure 14:
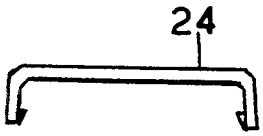
FIG. 14 shows an elevation view according to the arrow F of FIG. 12.
Figure 16:
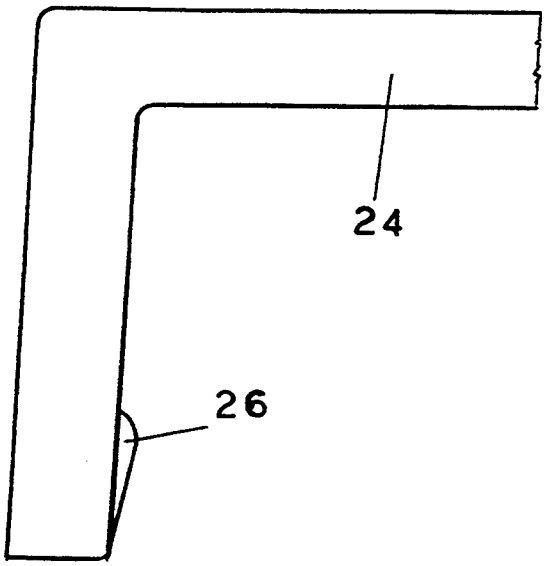
FIG. 16 is an enlarged detail of the cover edge.
Figure 12:
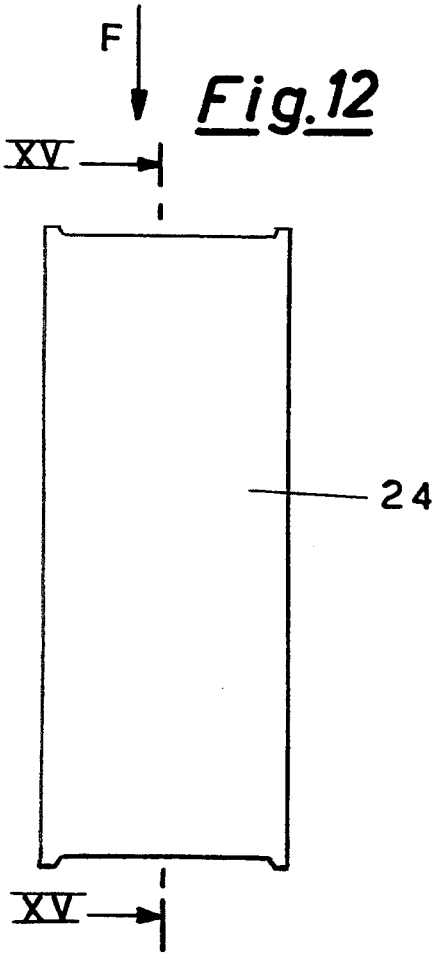
FIG. 12 shows a top plan view displaying a cover for the godet of FIGS. 7 and 11.
Figure 15:
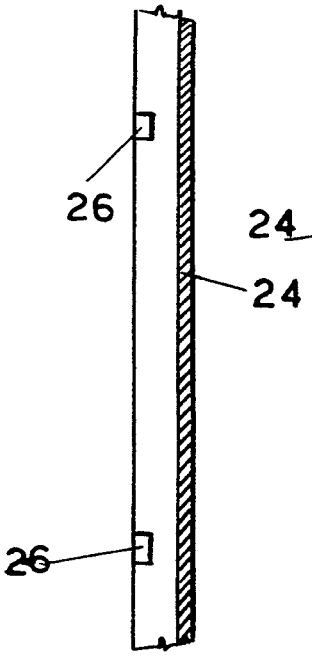
FIG. 15 shows a sectional view made according to the plane represented by the line XV—XV of FIG. 12.
Figure 13:
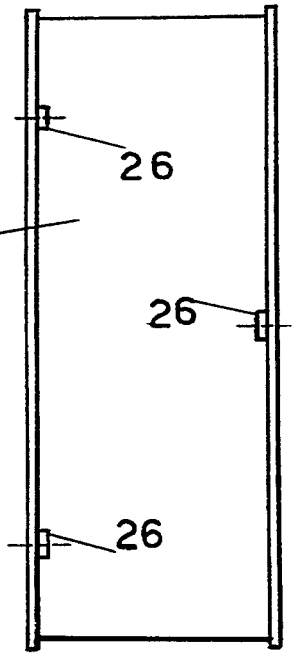
FIG. 13 shows a bottom plan view of the cover for the godet of FIG. 12.
Figure 26:
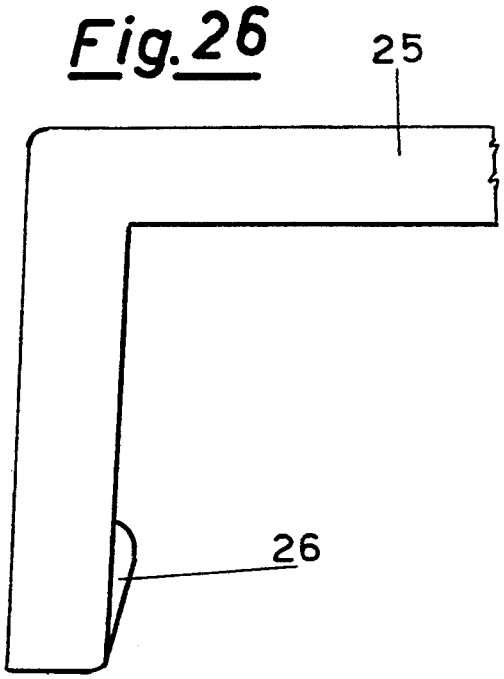
FIG. 26 is an enlarged detail of the cover edge.
Figure 24:
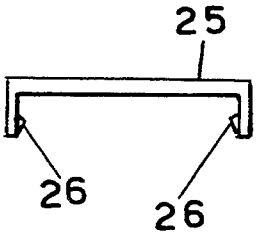
FIG. 24 shows an elevation view according to the arrow F1 of FIG. 22.
Figure 22:
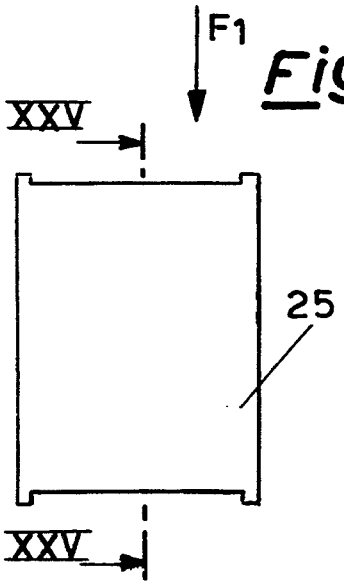
FIG. 22 shows a top plan view displaying a cover for the godet of FIGS. 17 and 21.
Figure 25:
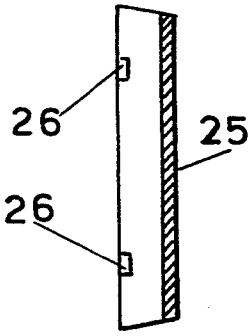
FIG. 25 shows a sectional view made according to the plane represented by the line XXV—XXV of FIG. 22.
Figure 23:
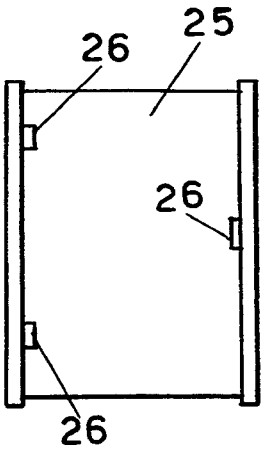
FIG. 23 shows a bottom plan view of the cover for the godet of FIG. 22.

As one may clearly see from FIG. 6 of the accompanying drawings, with the mutually opposite teeth 20, 21, a corresponding perimetrical tooth 23 provided on the edge of each of godet 14, 15 (FIGS. 11 and 21) is designed to get coupled, with a slightly forced engagement.

In the depicted exemplifying embodiment, the godet 14, 15 are modular, i.e., the godet 14 is twice as long as godet 15; in this way, each of said seats 13 can indifferently receive either a large godet 14 or two small godet 15.

When necessary, the godet 14, 15 housed inside said seats 13, can be easily disengaged by the user by applying a small upwards force with his/her fingers inserted between the tongues 22.

The godet 14, 15 are furthermore provided with respective covers 24, 25 (FIGS. 12, 16 and 22, 26), suitable for preventing the contained product from escaping and being unadvertently manipulated when the godet is not housed inside the interior of the case.

In order to stably couple, with possibility of easy removal, the covers 24, 25 onto their respective godet 14, 15, said covers are provided with mutually opposite teeth 26 suitable for getting coupled with the perimetrical tooth 23 of the same godet.

From the above, it clearly appears that the container module according to the present invention solves in an easy and cheap way the technical problems mentioned in the preamble to the disclosure.

Of course, the seats 13 provided inside the interior of the container 11 can be in a different number from as indicated for merely exemplifying purposes, and the same seats might be differently arranged and have different configurations. For example, as a function of the size of the godet, each seat can be provided with a different number of tooth pairs 20, 21.

The scope of the invention is hence defined by the following claims.

I claim:

1. A container module with replaceable trays, for a case, comprising:

a container module having a bottom wall perimetrically bounded by an upstanding sidewall; a plurality of upstanding partitioning ribs based on said bottom wall and cooperatively defining with said bottom wall and said sidewall a plurality of upwardly opening wells which are spaced from one another by free spaces defined between respective twos of said partitioning ribs; each said well at at least two opposed sites thereon, one of which is located on said sidewall and another of which is located on a respective partitioning rib, being provided with mutually opposed tray lip retainer teeth; each respective partitioning rib being vertically extended to form an elastically flexible tongue on which each respective said other site is located, further from said bottom wall then are upper edges of said partition ribs between said other sites; and a plurality of replaceable trays, each having a bottom wall perimetrically bounded by an upstanding sidewall having a perimetrically extensive, external tooth provided thereon distally of said bottom wall thereof; each said tray being sized and shaped to be removably snap fit into a respective said well so that at least two opposed ones of said teeth on said container module resiliently snap past the respective said external tooth of said tray.

2. The container module of claim 1, wherein:

each said well and each said tray is rectangular in plan.

3. The container module of claim 1, wherein:

at least one of said trays further includes a cover releasably fastened thereon.

4. The container module of claim 3, wherein:

said cover includes a top wall perimetrically bordered by a depending sidewall having at least two opposed teeth provided thereon at sites located distally of said top wall and arranged to resiliently snap past the respective said external tooth for releasably fastening the respective said cover on the respective said tray.

* * * * *